US007146769B1

(12) United States Patent
Culverson

(10) Patent No.: US 7,146,769 B1
(45) Date of Patent: Dec. 12, 2006

(54) TANDEM WINDOW ASSEMBLY SYSTEM

(75) Inventor: Mark O. Culverson, Lakeville, MN (US)

(73) Assignee: Larson Manufacturing of South Dakota, Inc., Brookings, SD (US)

( * ) Notice: Subject to any disclaimer, the term of this patent is extended or adjusted under 35 U.S.C. 154(b) by 477 days.

(21) Appl. No.: 10/460,739

(22) Filed: Jun. 12, 2003

Related U.S. Application Data

(60) Provisional application No. 60/388,844, filed on Jun. 14, 2002.

(51) Int. Cl.
*E06B 3/00* (2006.01)

(52) U.S. Cl. ..... 52/204.5; 52/204.51; 52/204.6

(58) Field of Classification Search ..... 52/204.5, 52/205.51, 204.6
See application file for complete search history.

(56) References Cited

U.S. PATENT DOCUMENTS 4,841,696 A * 6/1989 Miller ..... 50/202

* cited by examiner

*Primary Examiner*—Carl D. Friedman
*Assistant Examiner*—Yvonne M. Horton
(74) *Attorney, Agent, or Firm*—Patterson, Thuente, Skaar & Christensen, P.A.

(57) ABSTRACT

A unitary frame carries a primary window and a secondary window. The view area of the primary window is substantially the same as the view area of the secondary window. Two windows can be installed, to close an opening, at the same time using the frame. A frame, a secondary window and a casing can be installed as a unitary structure over an existing primary window.

17 Claims, 10 Drawing Sheets

TANDEM WINDOW ASSEMBLY SYSTEM

The benefit of a Jun. 14, 2002 filing date for Provisional Patent Application Ser. No. 60/388,844 is hereby claimed.

FIELD OF THE INVENTION

The invention pertains to combination windows. More particularly, the invention pertains to such windows where a primary window and a secondary, storm, window are carried on a common modular frame. Two windows can be installed at the same time, via a single frame, into new construction or existing openings.

BACKGROUND OF THE INVENTION

It has been known for many years to install primary windows on a dwelling and then add secondary or storm windows. This process requires two installations even where the secondary windows are installed immediately.

There continues to be a need to improve installation efficiency in new construction and in after market upgrades. Preferably such improvements would be achievable without a substantial increase in cost or complexity of the windows. Preferably such improvements would be commercially viable in both new construction and in after market improvements.

In addition, where known storm windows are installed on vinyl windows, they reduce the view area or daylight opening of the window. It would be preferable if this undesirable result could be eliminated.

In other potential installations, it is desirable to conserve the appearance of an existing window, which might be for example an antique. In such installations, the existing exterior casings are often badly deteriorated and in need of replacement. There continues to be a need in such installations to be able to incorporate secondary windows on the exterior side of the existing window to both conserve the appearance of the existing window and to protect same from the elements. Preferably, the secondary window could be installed as an upgrade to the existing window without having to remove the existing window.

DETAILED DESCRIPTION OF THE EMBODIMENTS

Figure 1:
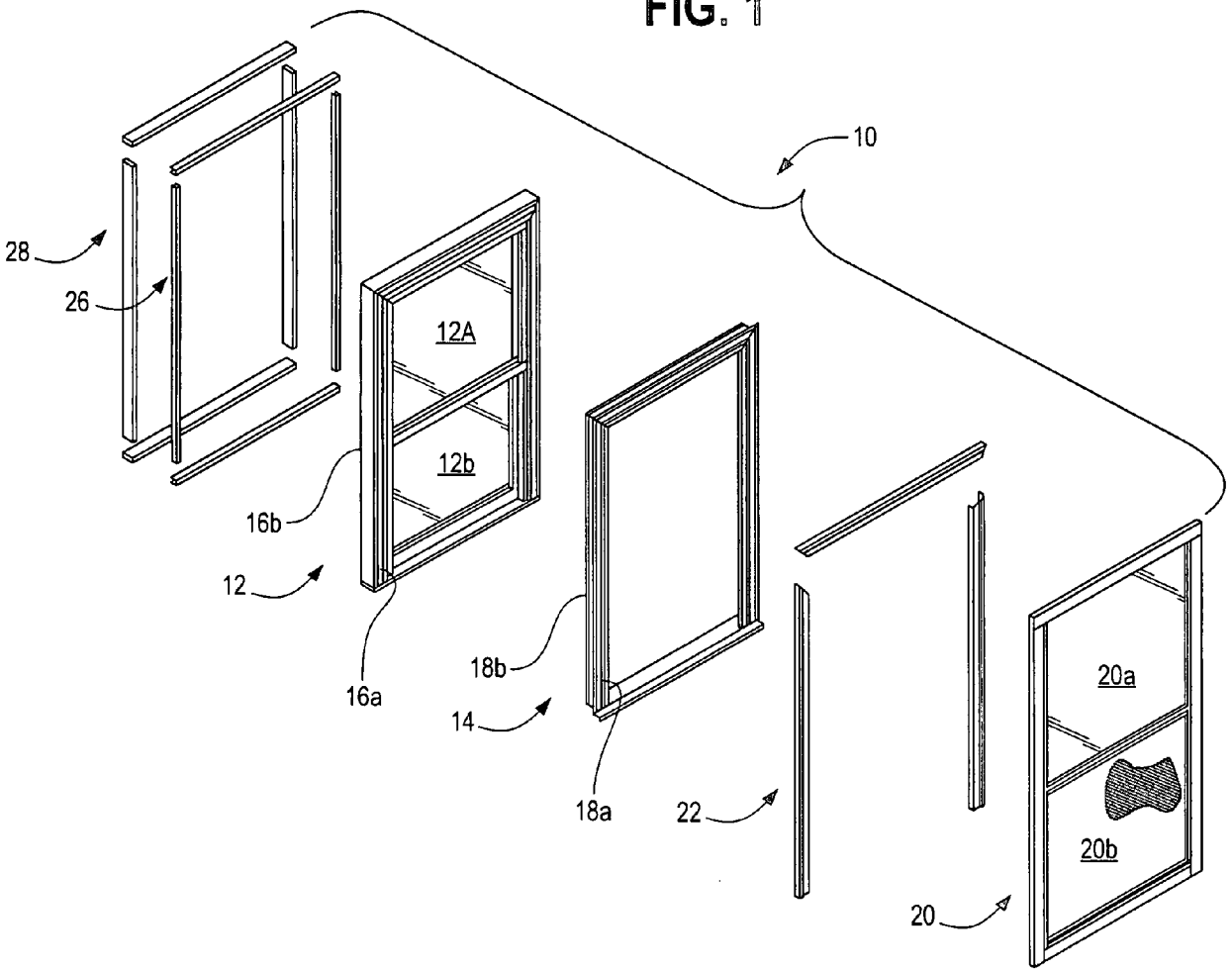
FIG. 1 is an exploded view of elements of a window system in accordance with the invention.

While embodiments of this invention can take many different forms, specific embodiments thereof are shown in the drawings and will be described herein in detail with the understanding that the present disclosure is to be considered as an exemplification of the principles of the invention and is not intended to limit the invention to the specific embodiment illustrated.

The present system incorporates a primary and a secondary window into a single window assembly. A sub-frame is attached to the exterior of the primary window providing a mounting surface for the secondary window.

The sub-frame also acts as a receiver for exterior casing. The exterior casing attaches to the exterior side of the sub-frame. All of the above-mentioned components can be factory assembled into a unitary, complete window system. That system can be installed in a single step.

Alternately, the primary window frame can be located in the opening and the secondary frame located thereon. Both frames can then be affixed to the opening at the same time.

The system supports a variety of installation options. These include: fasten through window jamb, fasten through nailing fin, with, or without storm window sashes installed in the sub-frame.

The system is compatible with retro-fit situations. The casing design allows an installer to fit the original opening without fillers.

The sub-frame is "stepped out" allowing for a larger size storm window. This window aligns with the primary window to maximize the window view or daylight opening.

The sub-frame, storm window and exterior casing can be formed of extruded aluminum, for example, which provides a tough, pre-finished, maintenance-free exterior surface. The primary window can be vinyl, wood, composite or metal.

All exterior components can be formed of aluminum and are available in dark colors. This is advantageous in that dark colors are not common in vinyl windows.

As noted above, the system in a disclosed embodiment includes an exterior casing. Windows such as known vinyl windows, do not have a casing.

Various exterior casing shapes can be provided. The tandem window structure provides sound insulation advantages. Mullions can be incorporated.

The system is adjustable to compensate for different wall thicknesses by incorporating interior extension jambs. The extension jambs can be wood or vinyl without limitation.

FIG. 1 illustrates a window system 10 in accordance with the present invention. It will be understood that the system 10 could be installed for either vertical movement of the respective panes or horizontal movement of the panes without limitation.

The indications of INTERIOR and EXTERIOR on FIG. 1 indicate those components of the system which are located within an interior of a structure and those which are located on the exterior of the structure when the system 10 is installed in an opening of the structure. Representative structures without limitation include residences, and commercial establishments such as stores and warehouses all without limitation.

System 10 includes a primary window 12 having first and second movable sashes 12*a* and 12*b* with glass panes. A sub-frame 14 is carried on an exterior side 16*a* of primary window 12. The sub-frame 14, which can be attached to the primary window 12 in a variety of ways as would be known to those of skill in the art, provides an exterior mounting surface 18*a* for the secondary window 20. The window 20 has movable sashes 20*a, b* having glass panes.

The sub-frame 14 also acts as a receiver for exterior casing 22. The exterior casing 22 is attached to an exterior surface 18*b* of sub-frame 14.

The above-enumerated components 12–22 can be assembled into a unitary structure and installed in an opening in the subject structure with a single installation. Installation can be with vertical or horizontal movement of sashes 12*a, b* an 20*a, b*.

As explained in more detail subsequently, an extension jamb receiver 26 can be attached to an interior surface 16*b* of the primary window at the time of manufacture of the system 10 or when installed in the respective structure. The extension jamb receiver 26 receives and carries an interior extension jamb 28 of a predetermined width but a variable depth to take into account a width parameter of the wall into which the system 10 is being mounted.

Figure 2:
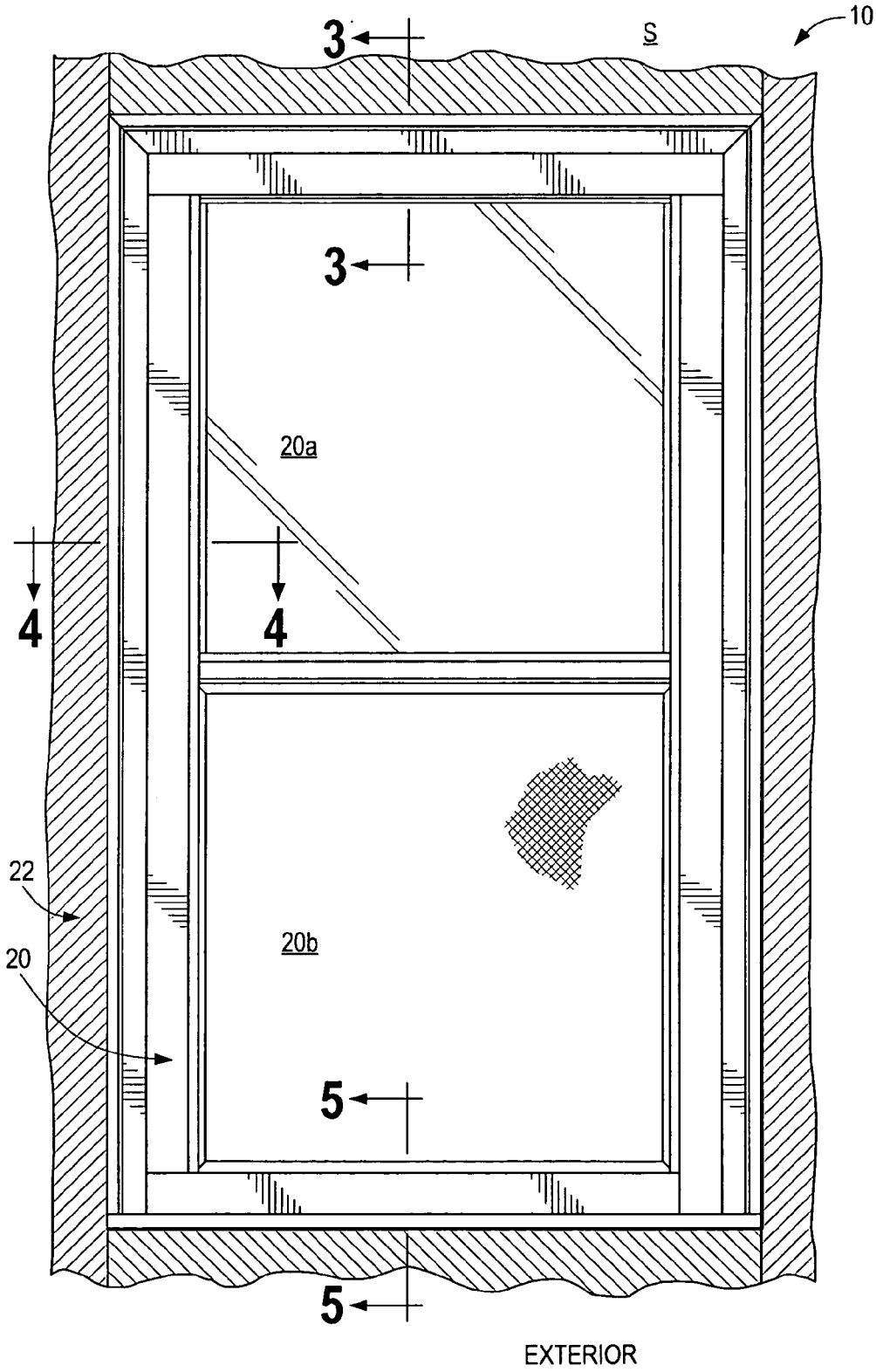
FIG. 2 is an external elevational view of the window of FIG. 1 looking toward a secondary window.

FIG. 2, an elevational view looking toward the secondary window 20, illustrates the system 10 installed for horizontal movement of the sashes 12*a, b* and 20*a, b*. The view of FIG. 2 illustrates exterior casing 22 which surrounds secondary window 20. The system 10 is illustrated in FIG. 2 installed in an opening O in a structure S. The type of structure is not a limitation of the present invention.

Figure 3:
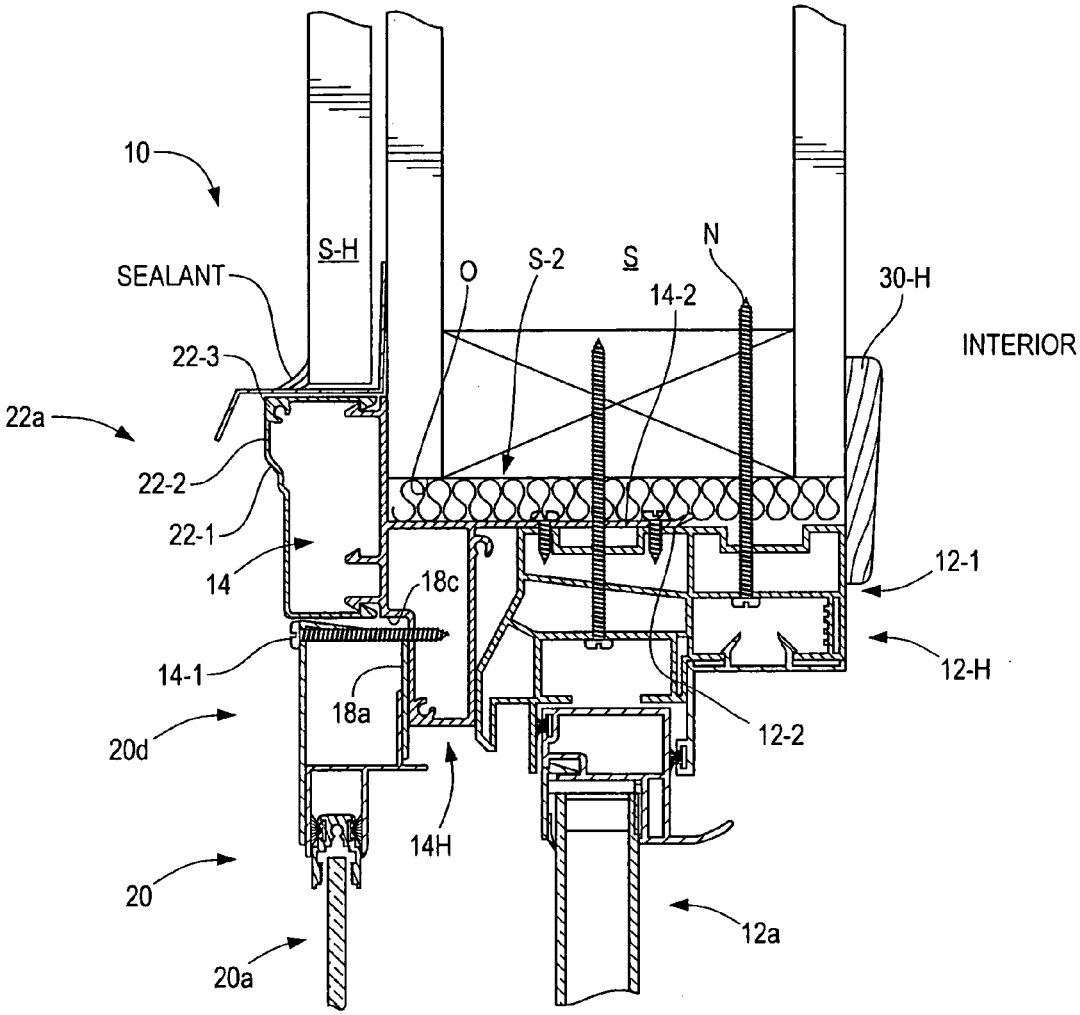
FIG. 3 is a sectional view along plane 3—3 of FIG. 2.

FIG. 3 is a head sectional view taken along plane 3—3, FIG. 2, of the head of the window system 10. As illustrated in FIG. 3, the secondary window 20 is attached to head member 14H of sub-frame 14 at surface 18*a*, on the exterior side of the assembly, via fasteners such as screws 14-1. It will be understood that a variety of fasteners or connection structures could be used without departing from the spirit and scope of the present invention. These include various types of fastenerless connections such as interference fit or snap-fit, all without limitation.

As illustrated in FIG. 3, sub-frame 14 has a "stepped" construction. Surface 18*a* abuts a perpendicular surface 118*c* which in turn abuts the surface 18*b*, which extends perpendicular to surface 18*c*, parallel to surface 18*a* and extends away from surface 18*a* to overlap a portion of the structure S adjacent to the opening O.

As illustrated in FIG. 3, the stepped nature of sub-frame 14 which receives a head frame portion 20*d* of secondary window 20. The stepped configuration supports and carries the window 20 which has a look-through or a viewing area in panes 20*a, b* which is substantially comparable to the look through or viewing area of the primary window panes 12*a, b*.

The head portion 22*a* of the exterior casing 22 slidably engages surface 18*b* of the sub-frame 14 with a snap-fit. It will be understood that other connectors could be used such as separate fasteners, interference fit or the like, all without limitation.

The exterior casing 22 incorporates framing features 22-1 and -2 in head section 22*a* to provide a more aesthetically pleasing exterior appearance of the system 10. The exterior casing 22 terminates in a surface 22-3, substantially perpendicular to the surface 22-2. The surface 22-3 abuts an exterior portion of the structure S adjacent an exterior treatment such as siding S-H. Any spaces between the surface 22-3 and siding S-H can be filled with a polyurethane sealant.

The sub-frame 14 also carries an extension member 14-2 which extends generally perpendicular to surface 18*b* and away from surface 18*b* toward primary window 12. The member 14-2 is spaced from the head portion of the opening O by a shim space S-2. This space can be filled with insulation as would be understood by those of skill in the art.

A head portion 12-1 of a frame for the primary window 12 incorporates a planer region 12-2 which extends parallel to and in contact with the extension 14-2 of the sub-frame. The header portion 12-1 and extension 14-2 could be attached together such as by welding, adhesives, fasteners or the like, all without limitation.

It will be understood by those of skill in the art that the primary window 12 could be a vinyl, a metal, a wood composite or a wood window all without limitation. Additionally, it will be understood that the secondary or storm window 20 could be a metal, such as aluminum, wood, wood-composite or vinyl, also all without limitation.

The system 10 is illustrated in FIG. 3 being attached to the structure S by a nail N as would be understood by those of skill in the art. It will be understood that the type of fastener is not a limitation of the present invention and could include screws, rivets or the like, all without limitation.

A selectively shaped trim element 30-H can be used to cover the space between the structure S and the window system 10 to complete the interior aesthetic appearance of the installed window system.

It will be understood that the specific disclosed, configuration of primary window and frame, secondary window and frame and sub-frame could be manufactured with a variety of configurations all without departing from the spirit and scope of the present invention. Additionally, the particular structure of the sashes or panes 12*a, b* and 20*a, b* are not limitations of the present invention.

Figure 4:
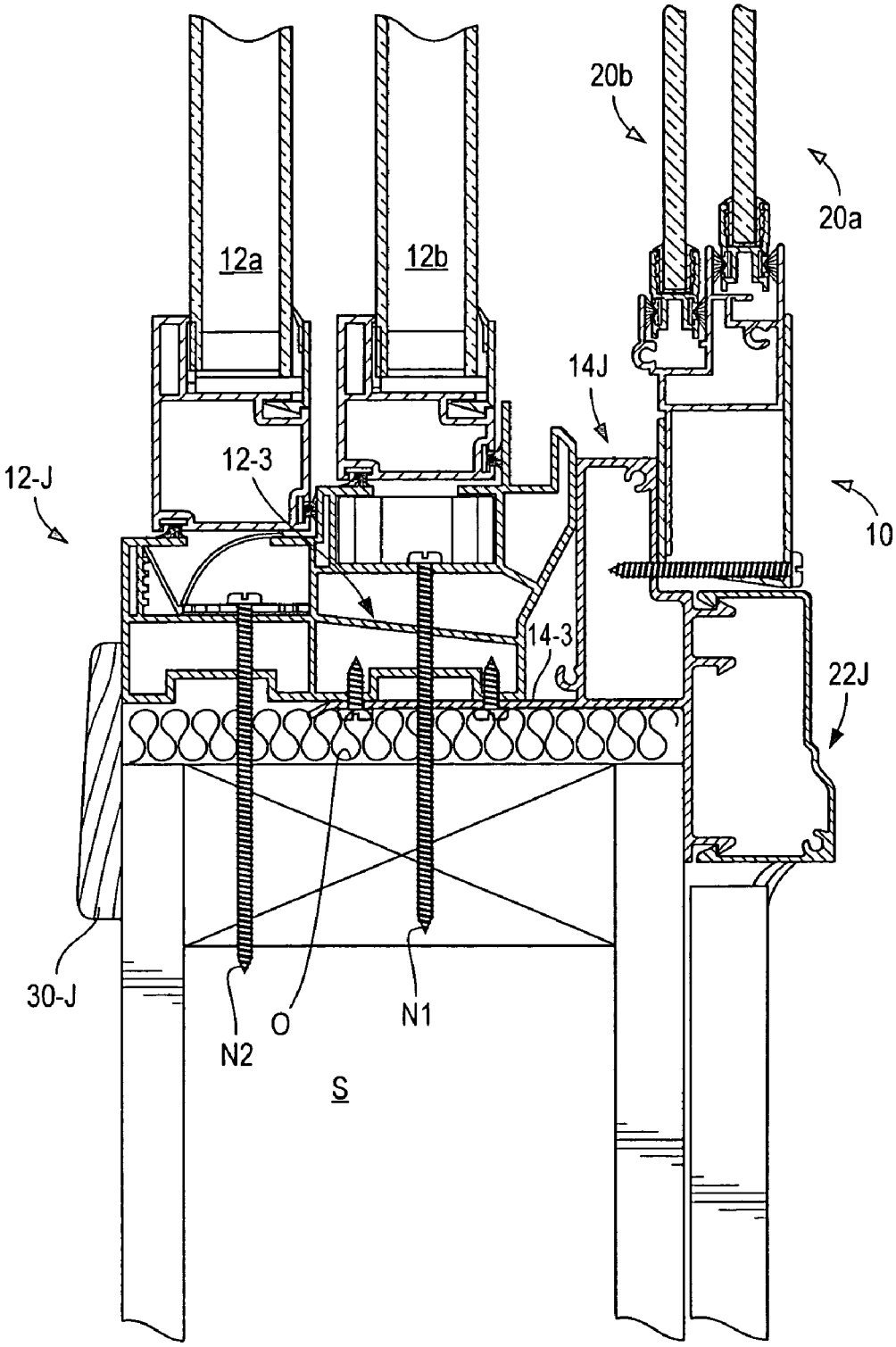
FIG. 4 is a sectional view along plane 4—4 of FIG. 2.

FIG. 4 is a sectional view taken along plane 4—4 of FIG. 2 in a direction from the interior side of the structure looking toward the exterior side thereof. The view of FIG. 4 is of the left jamb as viewed from the exterior of the structure 10. The right jamb is a mirror image thereof. As illustrated in FIG. 4, jamb 12-3 of the frame of primary window 12 abuts jamb portion of 14-3 of the sub-frame 14. The assemblage 10 is attached to the structure S using additional fasteners such as nails N1, N2.

As will be understood by those of skill in the art, the sashes or panes 12*a*, 20*a* can be moved to and from the jamb 12-3 opening and closing the viewing or look-through area of the system 10. This can also be removed from the respective frames as needed.

Figure 5:
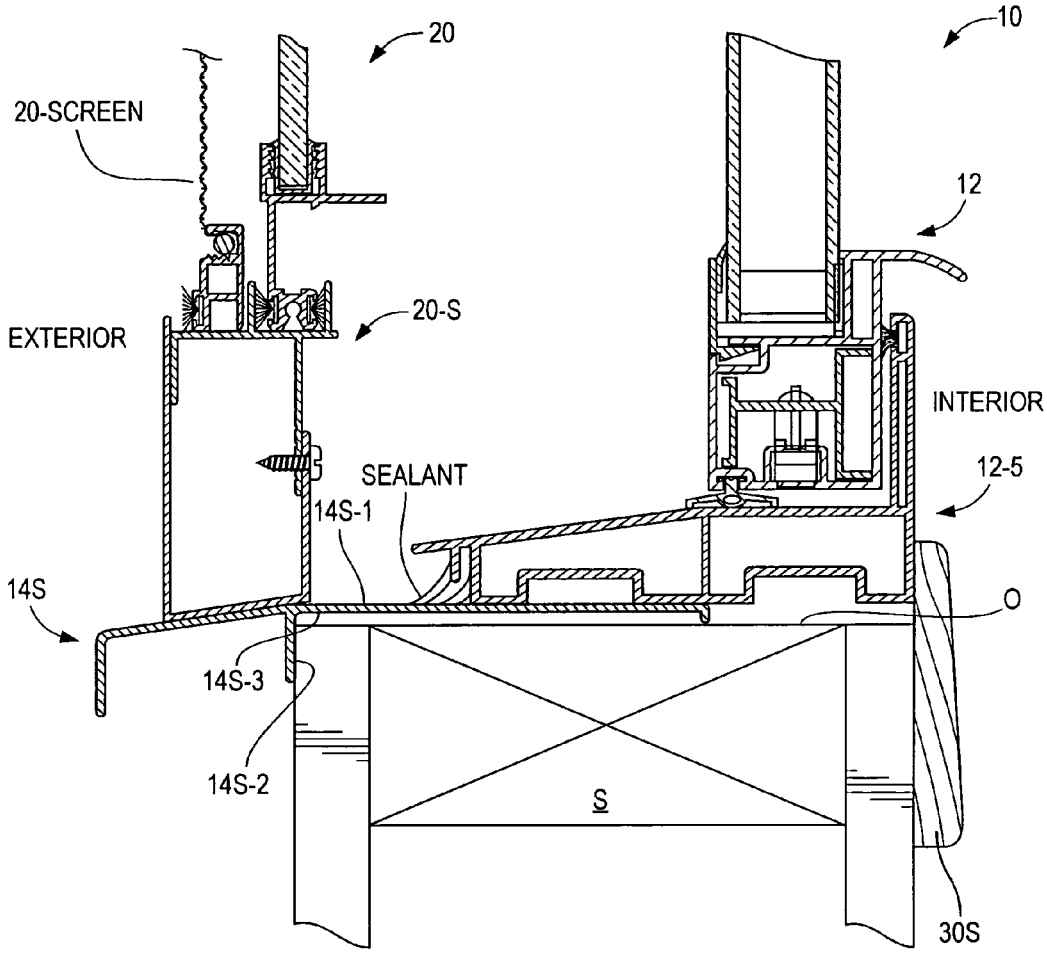
FIG. 5 is a sectional view along plane 5—5 of FIG. 2.

FIG. 5, a sectional view taken along plane 5—5 of FIG. 2, illustrates sill detail for the system 10. As illustrated therein, a sub-frame sill portion 14S extends out and downwardly from the sill surface of the opening O. The sill portion 20S of the secondary window 20 abuts the sill portion 12S of the frame of the primary window 12 at a surface 14S-1 of the sub-frame 14.

The sill section 14S also carries a back seal fin 14S-2 which abuts an exterior surface of the structure S. On the interior side, molding 30S covers the space between the opening O and the window structure 10 for aesthetic appearance and comfort. Insulation can be used to fill the shim space adjacent to surface 14S-3.

Figure 6:
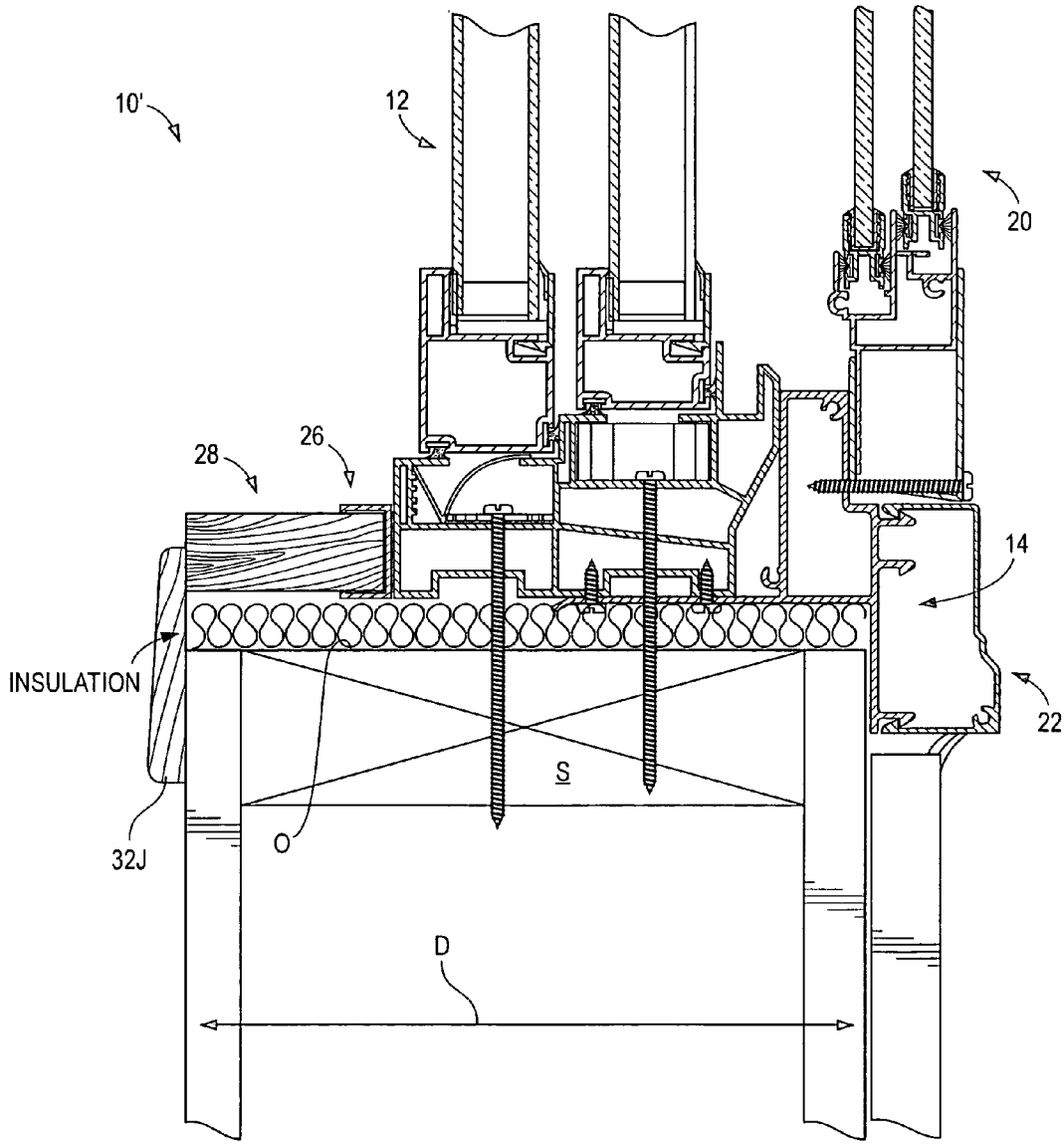
FIG. 6 is a sectional view of an alternate embodiment along plane 4—4 of FIG. 2.

FIG. 6 is a sectional view of a left jamb of a system 10' which incorporates an extension jamb receiver 26 which in turn carries an interior extension jamb 28. The right jamb is a mirror image.

The space between the opening O of the structure S and interior extension jamb 28 is covered by molding 32*j*. One of the advantages of the system 10' is that the extension jamb receiver 26 and extension jamb 28 make it possible to easily adapt to different wall depths D of structure S. All that needs to be done to compensate for different depths D is to use an appropriately deep extension jamb member 28.

If desired, a plurality of extension jamb members 28 of different depths can be provided with the system 10' to facilitate installation in different structures. The extension jamb 28 on each jamb can be finished as required.

Figure 7A:
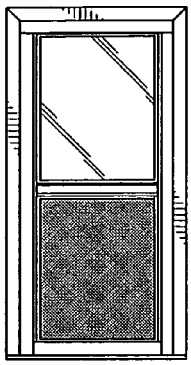
FIGS. 7A–7F illustrate various window configurations in accordance with the invention.
Figure 7B:
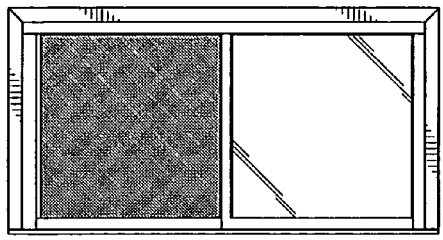
Figure 7C:
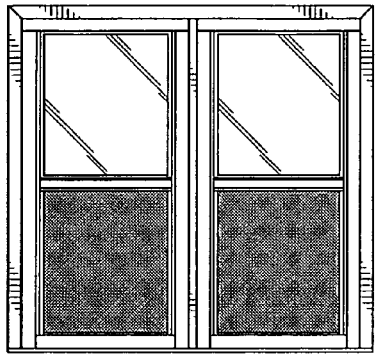
Figure 7D:
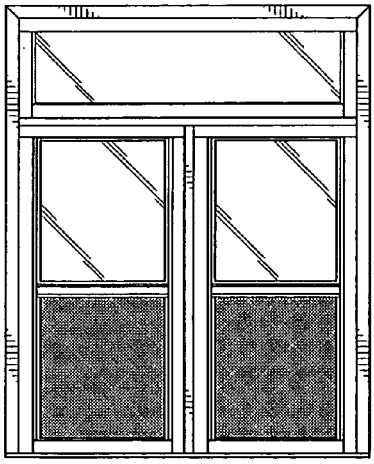
Figure 7E:
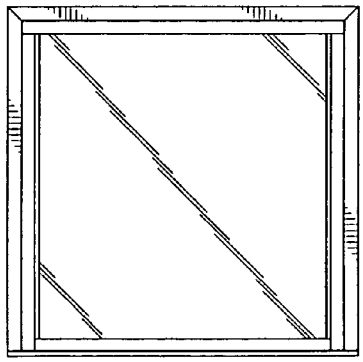
Figure 7F:
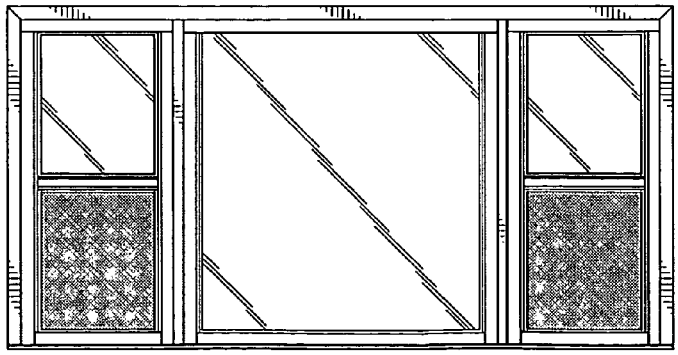

FIGS. 7A–7F illustrate various window configurations which can embody the present invention. FIGS. 7A and 7B illustrate double-hung single-hung or slide-type window structures with which the system 10 can be used. FIGS. 7C and 7D illustrate dual double-hung or single-hung windows without and with transom which can be configured with dual sub-frames and secondary windows in accordance with the system 10. Finally, FIG. 7E illustrates a picture window having a non-moving pane and 7F illustrates a picture window having a non-moving pane bounded by double-hung or single-hung windows all of which can be configured in accordance with the system 10.

For example and without limitation, FIG. 7C can be configures with two adjacent sub-frames 14 to which can be coupled to secondary windows 20. Alternately, a double wide sub-frame 14' could be used with the window configuration of FIG. 7C or 7D.

The picture window of FIG. 7E could be combined with an appropriate sized sub-frame 14" which in turn could carry an appropriately sized secondary window 20' corresponding to a picture-type secondary window having a size and a shape in accordance with the picture window of FIG. 7E. Similarly, FIG. 7F can be implemented with two sub-frames 14 combined with a picture window sub-frame, as in FIG. 7E.

The above configurations all exhibit improved sound insulating characteristics over those of a primary window without a storm window. Other configurations come within the spirit and scope of the present invention.

Figure 8:
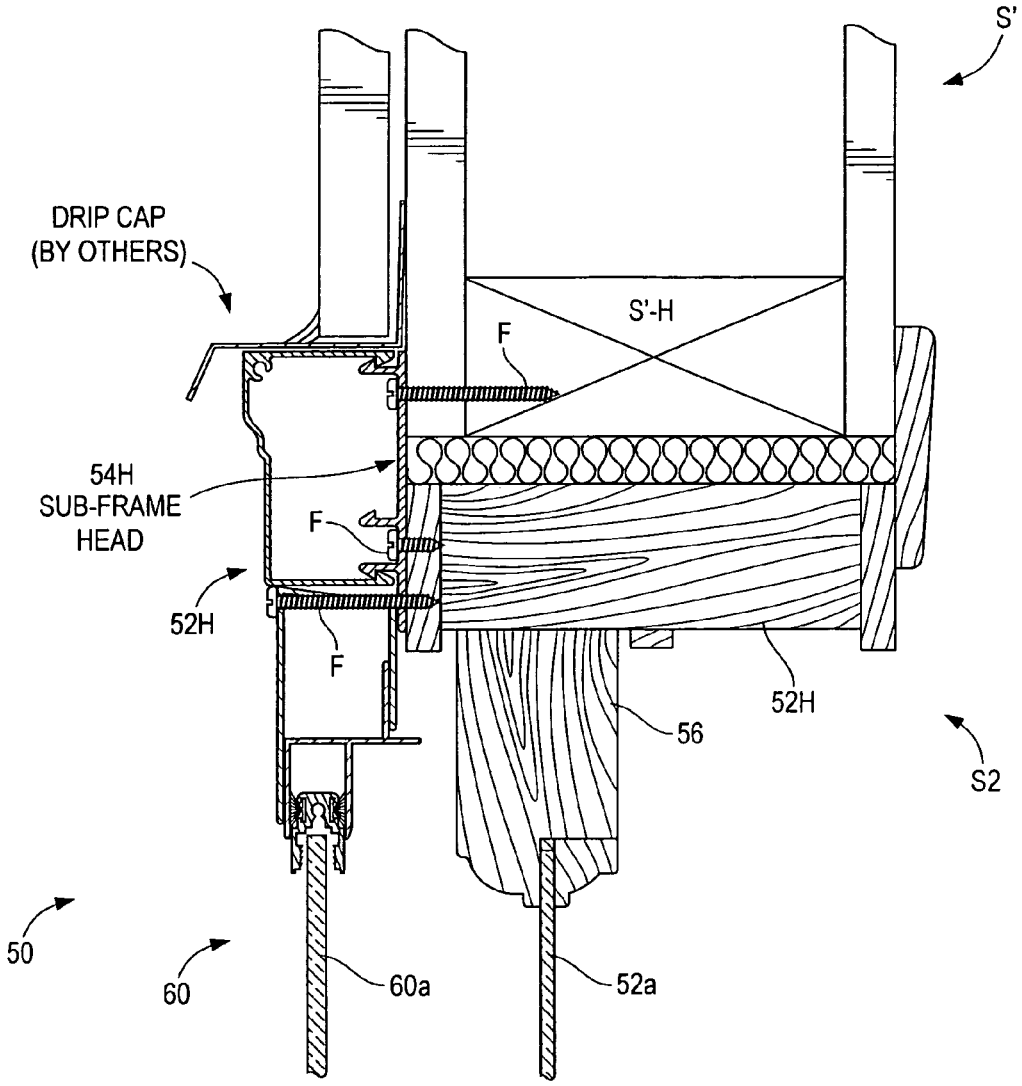
FIG. 8 is a sectional view taken generally along a section such as plane 3—3 of FIG. 2 illustrating head details of an alternate window system in accordance with the present invention.
Figure 9:
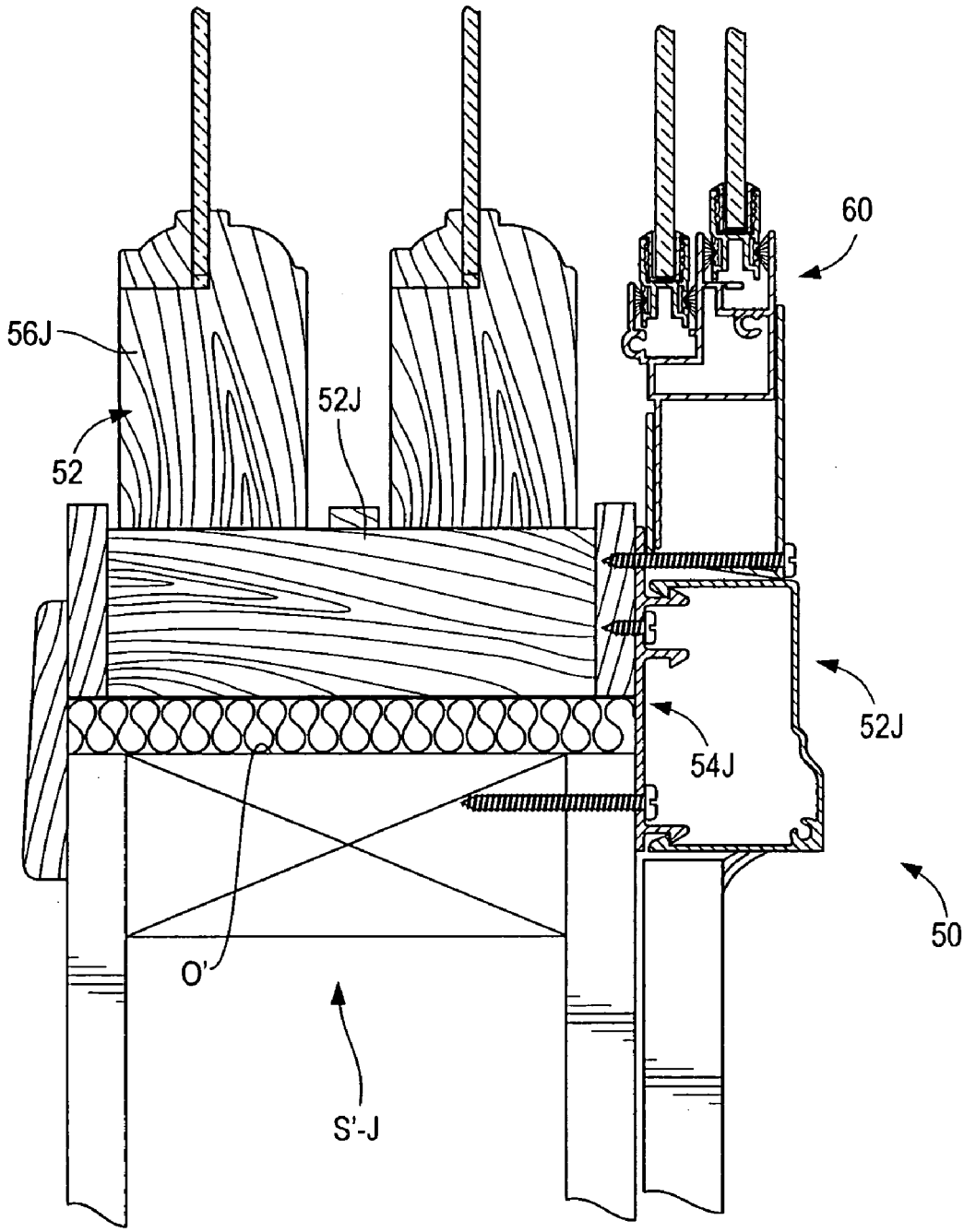
FIG. 9 is a sectional view taken generally along a section such as plane 4—4 of FIG. 2 illustrating left jamb detail of the window system of FIG. 8, the right jamb being a mere image thereof.
Figure 10:
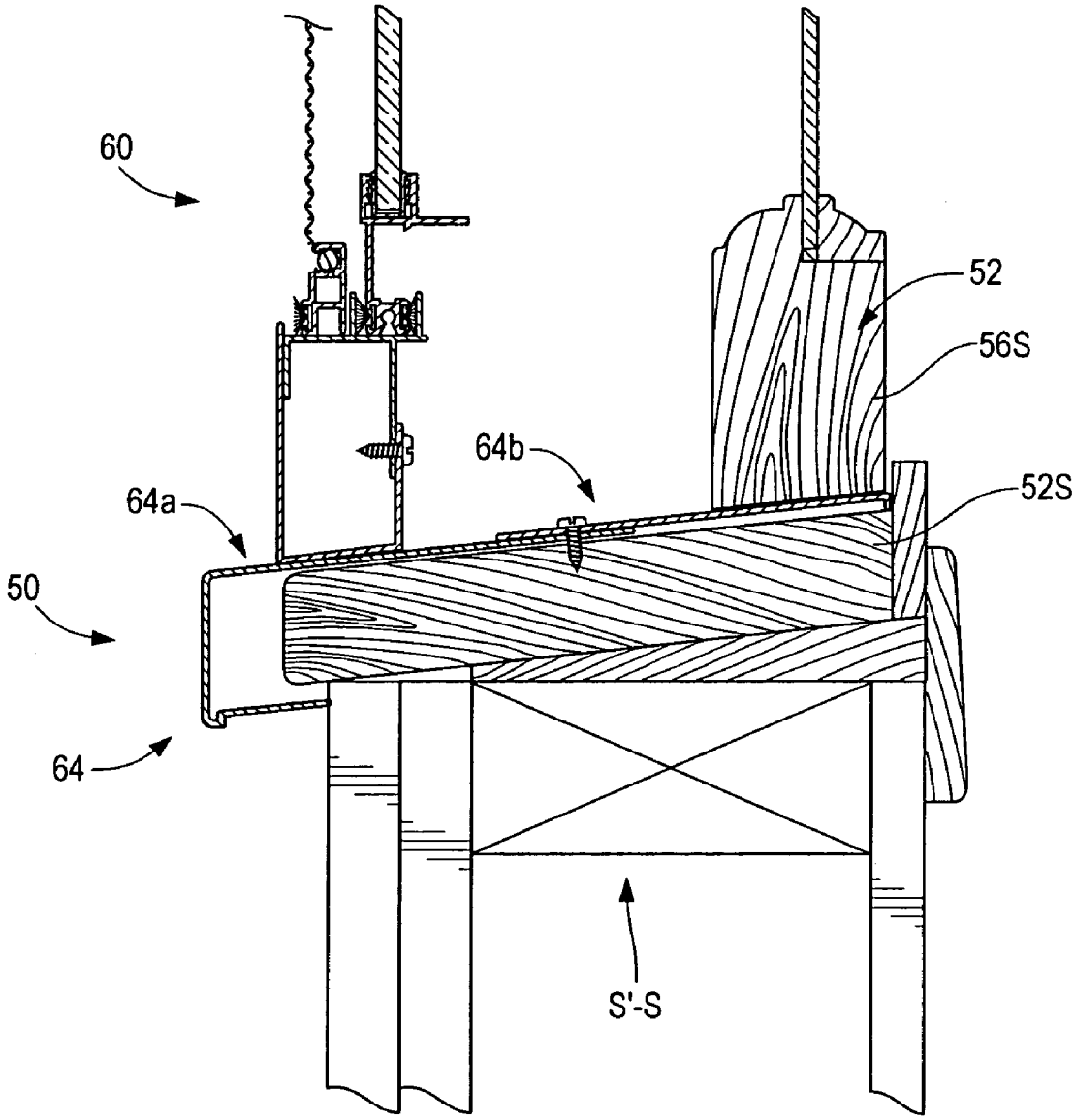
FIG. 10 is a sectional view taken generally along a section such as plane 5—5 of FIG. 2 illustrating sill detail of the window system of FIG. 8.

FIGS. 8–10 are sectional views respectively of the head, left jamb, and sill, corresponding to planes 34 and 35 of FIG. 2, of an alternate window system 50 usable with existing primary windows, such as primary window 52. The system 50 is intended to be coupled to the structure S' to which the primary window 52 is attached.

As illustrated in FIGS. 8–10, system 50 can be attached to the head, jambs and sill of the structure S' which supports the primary window 52. With respect to FIG. 8, a sub-frame head 54H is attached by fasteners F which could be screws, nails or the like to head member S'-H as well as 52H. The sub-frame 54 is substantially planar in FIGS. 8 and 9. FIG. 9 illustrates left jamb detail. The right jamb detail is a minor image of FIG. 9.

An exterior casing 52, illustrated in FIGS. 8 and 9 as sections 52H and 52J is in turn attached to the respective sub-frame portions such as 54H, 54J. Secondary window 60 is attached in part to respective sub-frame portions such as 54H, J as well as header and jamb portions 52H, J of the primary window 52 by respective fasteners.

It should be noted that prior to installation of the system 50 on the structure S', the existing exterior casing is removed from the primary window 52 without removing the window 52 itself. This in turn leaves the structural elements of the window 52 including the frame, such as members 52H, J, in place and undisturbed. When the sub-frame 54 is attached to the structure S', it covers the exterior surfaces of the structure S' in the vicinity of the primary window 52 along with the exterior surfaces of the frame 56 of the window 52.

Once the new exterior casing 52 and the secondary window 60 are attached to the sub-frame 54, the wood or interior surfaces of the structure S' in the vicinity of the window 52 are all covered with maintenance free, weather resistant materials such aluminum or exterior vinyl. This in turn protects the frame 52H, J of the window 52 as well as the sash members 56H, J from the weather. It will be understood that the existing primary window 52 could be a single-hung or double-hung window or a sliding window, or a picture window, all without limitation.

FIG. 10 illustrates the details of the sill structure associated with the system 50. The sub-frame 54 includes a two-piece sub-frame sill structure 64 having members 64*a* and 64*b*. The sill structure portion 64*b* can slidably engage the sill portion 56S of the sash of the existing primary window 52 and cover the existing sill 52S with weather resistant metal, such as aluminum, or exterior vinyl. As in the case of the head and the jamb portions, discussed previously FIGS. 8 and 9, the sill structure 64 is formed on exterior surfaces of weather resistant metal or exterior vinyl which encloses and covers any weather susceptible or wood members such as sill 52S or associated sill support portions of the structure S'. Hence, the opening O' into the structure S', which is filled by the primary window 52, is located behind newly applied exterior, weather resistant materials such aluminum or exterior vinyl.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. A window assembly installable into an opening comprising:

a primary window having a first frame and at least one primary sash;

a second frame attached to the primary window, the second frame is adapted to carry a storm window, having a storm sash, at least the frames are installable in an opening as a common unit with the storm window installable on the respective frame to close the opening, where the second frame is configured such that the viewing areas for the at least one sash and the storm sash are substantially identical, and where the second frame bounds the first frame and has a right angle cross section with a portion thereof framing a substantially planar rectangle on the storm sash side with the rectangle, at least in part, overlapping the opening; and a jamb receiver adjacent to the primary window.

2. An assembly as in claim 1 where the primary window comprises one of wood, a wood composite, a metal, or a plastic.

3. An assembly as in claim 1 where the secondary window comprises one of a wood exterior, a metal exterior or a plastic exterior.

4. A multiple window assembly comprising:

a primary window;

a stepped sub-frame attached to one side of the nary window;

a secondary window carried by the sub-frame with the windows and the sub-frame forming a unitary structure; and an extension jamb receiver attached to another side of the primary window.

5. An assembly as in claim 4 which includes an extension jamb carried by the receiver.

6. An assembly as in claim 4 with a casing located adjacent to the secondary window.

7. An apparatus comprising:

an extension frame having first and second sides, configured with first and second spaced apart surfaces on one side, the surfaces are oriented to be located adjacent to a frame of a primary window, third and fourth spaced apart surfaces on the other side;

a secondary window carried on the frame, attached to the frame at the third and fourth surfaces and a casing attached to the same, adjacent to parts of the secondary window.

8. An apparatus as in claim 7 where the frame, secondary window and casing form a unitary structure attachable to a structure with the secondary window overlying a primary window attached to the structure where the secondary window provides a see-through area substantially equal to a see-through area of the primary window.

9. An apparatus as n claim 7 with the casing extending along multiple sides of the secondary window.

10. An apparatus as in claim 7 where the frame includes a sill region which extends along a surface of the secondary window.

11. An apparatus as in claim 10 where the sill region defines an internal volume bounded except for one sill side where the one sill side extends away from the secondary window.

12. An apparatus as in claim 11 where the casing slidably engages the extension frame with one of a snap fit or an interference fit.

13. An apparatus as in claim 12 where the expansion frame has at least one of a substantially planar cross section or an L-shaped cross section.

14. An apparatus as in claim 7 where the expansion frame has at least one of a substantially planar cross section or an L-shaped cross section.

15. An apparatus as in claim 13 where the expansion frame is formed of metal and the casing is formed of a resin.

16. A structure to up-grade and protect an installed primary window from the elements comprising:

a primary window bounding frame, the frame has at least one fastener receiving region to facilitate attaching the frame so it surrounds the primary window;

a casing attached to the frame, displaced from the primary window with the frame therebetween.

17. A structure as in claim 16 which includes a secondary window attached to the frame, adjacent to the casing, displaced from the primary window with the frame therebetween.

* * * * *

UNITED STATES PATENT AND TRADEMARK OFFICE

CERTIFICATE OF CORRECTION

PATENT NO. : 7,146,769 B1
APPLICATION NO. : 10/460739
DATED : December 12, 2006
INVENTOR(S) : Culverson It is certified that error appears in the above-identified patent and that said Letters Patent is hereby corrected as shown below:

Column 3, Line 10:
Delete "an" and insert --and--.

Column 3, Line 37:
Delete "118*c*" and insert --18*c*--.

Column 4, Line 4:
Delete "planer" and insert --planar--.

Column 5, Line 20:
Delete "configures" and insert --configured--.

Column 5, Line 48:
Delete "minor" and insert --mirror--.

Column 6, Line 57:
Delete "nary" and insert --primary--.

Column 7, Line 17:
Delete "n" and insert --in--.

Signed and Sealed this

Twenty-third Day of October, 2007

JON W. DUDAS
*Director of the United States Patent and Trademark Office*

UNITED STATES PATENT AND TRADEMARK OFFICE

CERTIFICATE OF CORRECTION

PATENT NO. : 7,146,769 B1
APPLICATION NO. : 10/460739
DATED : December 12, 2006
INVENTOR(S) : Culverson It is certified that error appears in the above-identified patent and that said Letters Patent is hereby corrected as shown below:

Title page, item 73 should read:
After "Manufacturing" insert --Company--.

Signed and Sealed this

Eighteenth Day of November, 2008

JON W. DUDAS
*Director of the United States Patent and Trademark Office*